US010422118B2

(12) United States Patent
Adams

(10) Patent No.: US 10,422,118 B2
(45) Date of Patent: Sep. 24, 2019

(54) DRAIN APPARATUS AND SYSTEM

(71) Applicant: Jason Wade Adams, Brighton, CO (US)

(72) Inventor: Jason Wade Adams, Brighton, CO (US)

( * ) Notice: Subject to any disclaimer, the term of this patent is extended or adjusted under 35 U.S.C. 154(b) by 0 days.

(21) Appl. No.: 14/791,320

(22) Filed: Jul. 3, 2015

(65) Prior Publication Data

US 2016/0002906 A1 Jan. 7, 2016

Related U.S. Application Data

(60) Provisional application No. 62/021,035, filed on Jul. 4, 2014.

(51) Int. Cl.
*E03F 5/04* (2006.01)

(52) U.S. Cl.
CPC ..... *E03F 5/0407* (2013.01); *E03F 5/0409* (2013.01); *E03F 2005/0414* (2013.01)

(58) Field of Classification Search
CPC ..... E05F 2005/0412; E05F 2005/0413; E05F 2005/0414; E05F 2005/0415; E05F 5/0407; E05F 5/0409
USPC ..... 137/362; 285/42; 7/157
See application file for complete search history.

(56) References Cited

U.S. PATENT DOCUMENTS 3,809,411 A * 5/1974 Emberson ..... E04D 13/0409 285/42
4,850,617 A * 7/1989 Moberly ..... F16L 41/088 285/137.11
5,155,957 A * 10/1992 Robertson ..... A62C 2/065 137/360
7,735,512 B1 * 6/2010 Ismert ..... E03F 5/0407 137/362
2005/0127666 A1 * 6/2005 Dole ..... F16L 27/1012 285/233
2005/0189028 A1 * 9/2005 Burkes ..... F16L 58/1036 138/98
2012/0017377 A1 * 1/2012 Hayden ..... B23D 21/08 7/157
2013/0193042 A1 * 8/2013 Hull ..... E03F 5/0407 210/164

* cited by examiner

*Primary Examiner* — Kevin F Murphy
*Assistant Examiner* — Paul J Gray
(74) *Attorney, Agent, or Firm* — Trenner Law Firm, LLC; Mark D. Trenner

(57) ABSTRACT

An example drain apparatus includes a drain body for connection to a plumbing system. The example drain apparatus also includes a top drain assembly having a compressible fitting, the top drain assembly configured for removable installation within the drain body. An example drain system includes an apparatus having a drain body and a top drain assembly for installation with the drain body. The example drain system includes a jig configured to cut the drain body below an upper surface of a floor the drain body is installed in so that the top drain assembly is fitted to the drain body substantially level with the upper surface of the floor.

20 Claims, 16 Drawing Sheets

DRAIN APPARATUS AND SYSTEM

PRIORITY

This application claims the priority benefit of U.S. Provisional Patent Application No. 62/021,035 filed on Jul. 4, 2014 titled "Drain Apparatus and System" of Jason Wade Adams, hereby incorporated by reference for all that is disclosed therein.

BACKGROUND

Commercial buildings (stores, offices, etc.), and even residential, hotels, stadiums, and multi-use facilities, require plumbing systems to deliver water and waste to and from bathrooms, kitchens, and other areas. Typically, the plumbing system is installed during the rough-in phase of construction, and then completed during the finishing stage.

DETAILED DESCRIPTION

A drain apparatus and system is disclosed. An example drain apparatus and system includes a top drain assembly with a compressible fitting, and a drain body, wherein the drain body may be generally cylindrically-shaped. In an example, the compressible fitting secures the top drain assembly to the drain body, although other configurations are also contemplated (e.g., clamp-fit). The drain body may have an adjustable flange fitted on its exterior, in an example, the flange is configured to receive a membrane.

In an example, the drain apparatus may be installed as a two-part system, wherein the body is pre-installed in a base (e.g., prior to pouring concrete floor, or on a metal or wood decking), and the top is installed after installation of the finished floor (e.g., tile or hardwood flooring). It is noted that the body does not have to be perfectly level or plumb when positioned in the base. For example, the body is configured to be cut (e.g., using a jig) to the desired height after the finished floor is set, thereby determining the finished height of the drain or clean out. As such, the cut cannot be wrong.

In an example, the drain body is manufactured of Rotomold® or other material with good resistance to impact damage. The drain body may also be coated in a thin layer of rubber to provide a water tight seal (e.g., when set in concrete). An optional collar may be provided for an additional water tight seal if desired.

In an example, the drain apparatus and system may help to reduce or altogether eliminate time-consuming and/or multiple visits by a plumbing contractor during the installation process, thereby reducing cost. The drain apparatus and system may also help reduce or altogether eliminate tight installation tolerances typically encountered with drain installation, and may also protect the finished drain from damage both during and after installation.

Before continuing, it is noted that as used herein, the terms "includes" and "including" mean, but is not limited to, "includes" or "including" and "includes at least" or "including at least." The term "based on" means "based on" and "based at least in part on."

Figure 1:
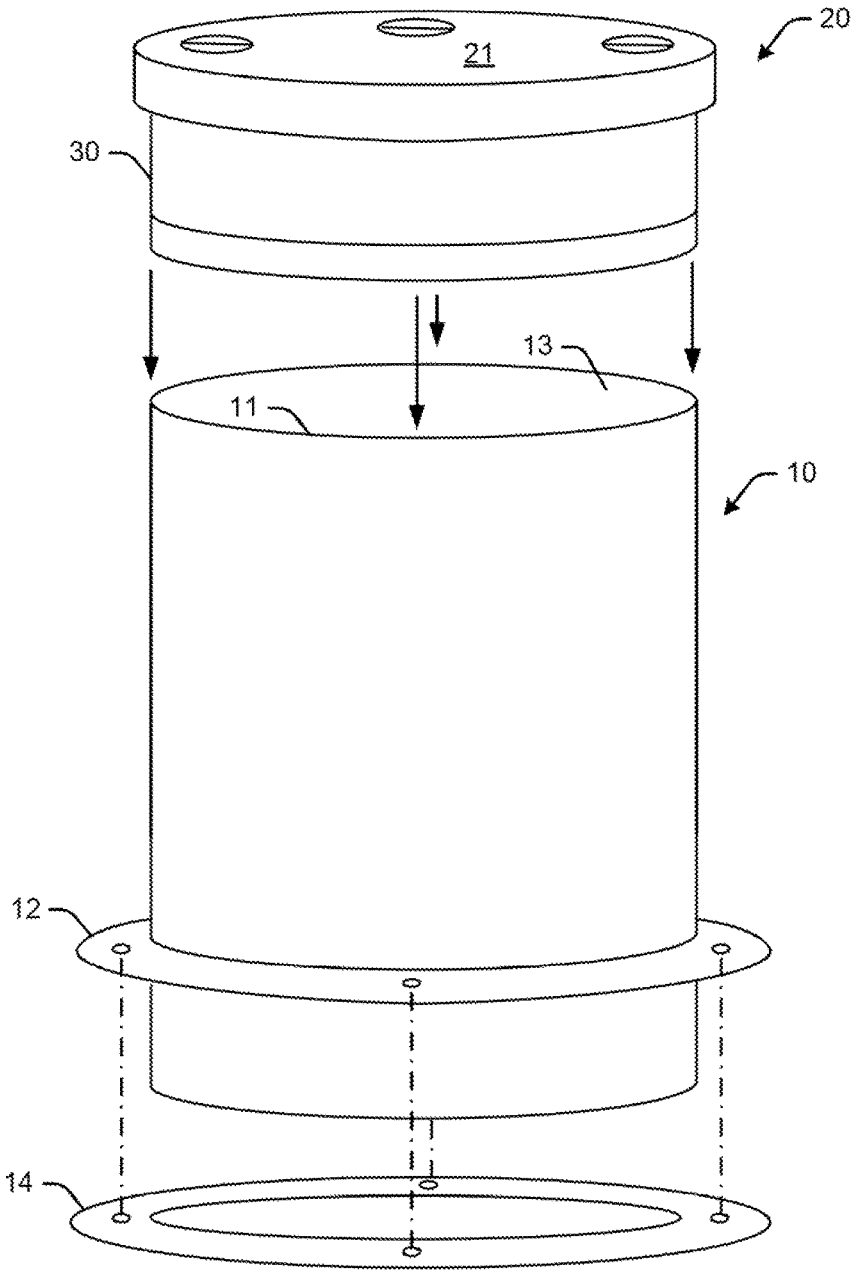
FIG. 1 shows an example drain apparatus and system.

FIG. 1 shows an example drain apparatus and system. In an example, the drain apparatus includes a drain body 10 for connection to a plumbing system (not shown), such as but not limited to a household and commercial sewage line. The drain apparatus also includes a top drain assembly 20 having a compressible fitting 30. The top drain assembly 20 may be configured for removable installation within the drain body 10.

In an example, the drain body 10 is configured for pre-installing in a base (e.g., a concrete subfloor, or metal or wood decking) before finishing a floor (e.g., with tile or other overlay). The drain body 10 can then be cut below an upper surface of the finished floor so that when the top drain assembly 20 is fitted to the drain body 10, an upper surface 21 of the top drain assembly 20 covers the opening of the drain body 10 substantially level with the upper surface of the finished floor, as explained in more detail below with reference to the illustration of FIGS. 6-13.

In an example, the walls of the drain body 10 are made of multiple layers. An example layer may be a rubber, e.g., to enable a water-tight (and/or gas-tight) seal. Another example layer may be a fire stop layer. By way of illustration, the wall may have four layers, such as an outer layer that may be a plastic such as a rotationally molded plastic (e.g., Rotomold®) that is resistant to impact damage. This plastic may be covered by a thin layer of rubber to provide a water tight seal with a surrounding concrete matrix or other flooring. Interior to this outer layer may be a fire stop layer. Further to the interior may be an annular space to which a pipe coupling band may be attached. The innermost layer may serve as a pipe hub connector.

In an example, the drain body 10 includes a flange 12. The flange 12 may be adjustable (e.g., along at least a portion of the length of the drain body 10). The flange may aid with installation of the drain body 10, e.g., by anchoring the drain body 10 in a fixed position. A flange ring collar 14 may also be provided, e.g., to enable a water tight seal. In an example, the flange 12 may be configured to receive a membrane, such as an O-ring seal.

Figure 2A:
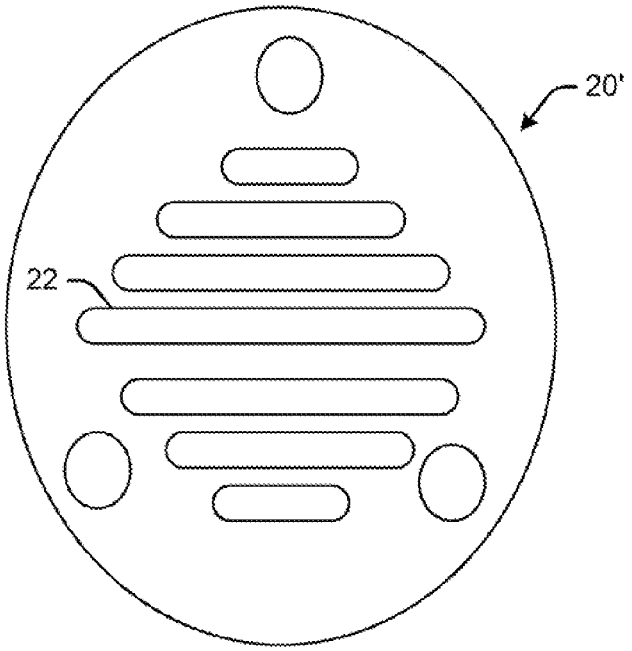
FIG. 2A is a top view of an example drain cover with drainage.
Figure 2B:
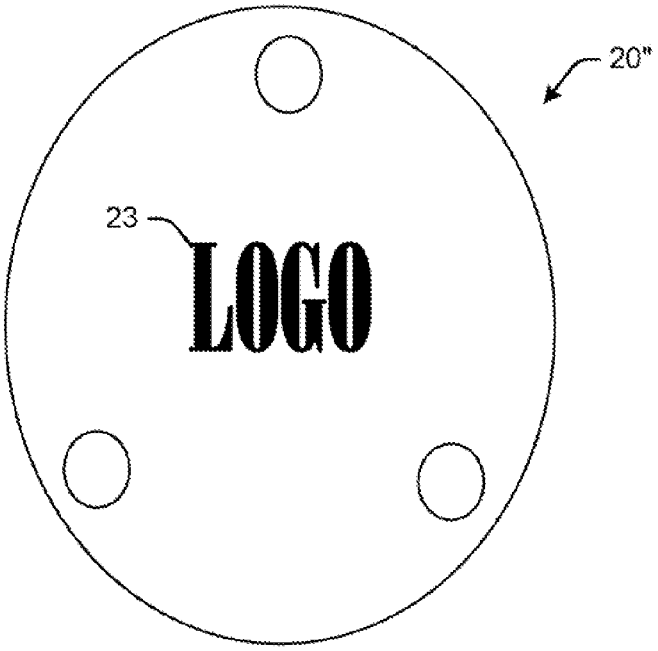
FIG. 2B is a top view of an example drain cover without drainage.

Example drain covers 20 of the drain apparatus are illustrated in FIGS. 2A-2B. FIG. 2A is a top view of an example drain cover 20' with openings 22 for drainage. FIG. 2B is a top view of an example drain cover 20" without drainage. In an example, the drain cover 20" may include a logo 23 (e.g., as illustrated in FIG. 2B) for the manufacturer or installer. Other information (e.g., installation instructions, address/phone number, etc.) and/or design may also be included on the drain cover 20". For example, the logo may serve as identification (e.g., "industrial waste" versus "sewage" labels) for identification (ID) caps 20".

In an example, the drain cover 20 is replaceable. For example, a drain cover 20" may be used to temporarily cover a drain during construction (e.g., to keep debris out of the drain), and then the temporary cover may be removed and replaced with a drain cover 20' to provide drainage during use.

Figure 3:
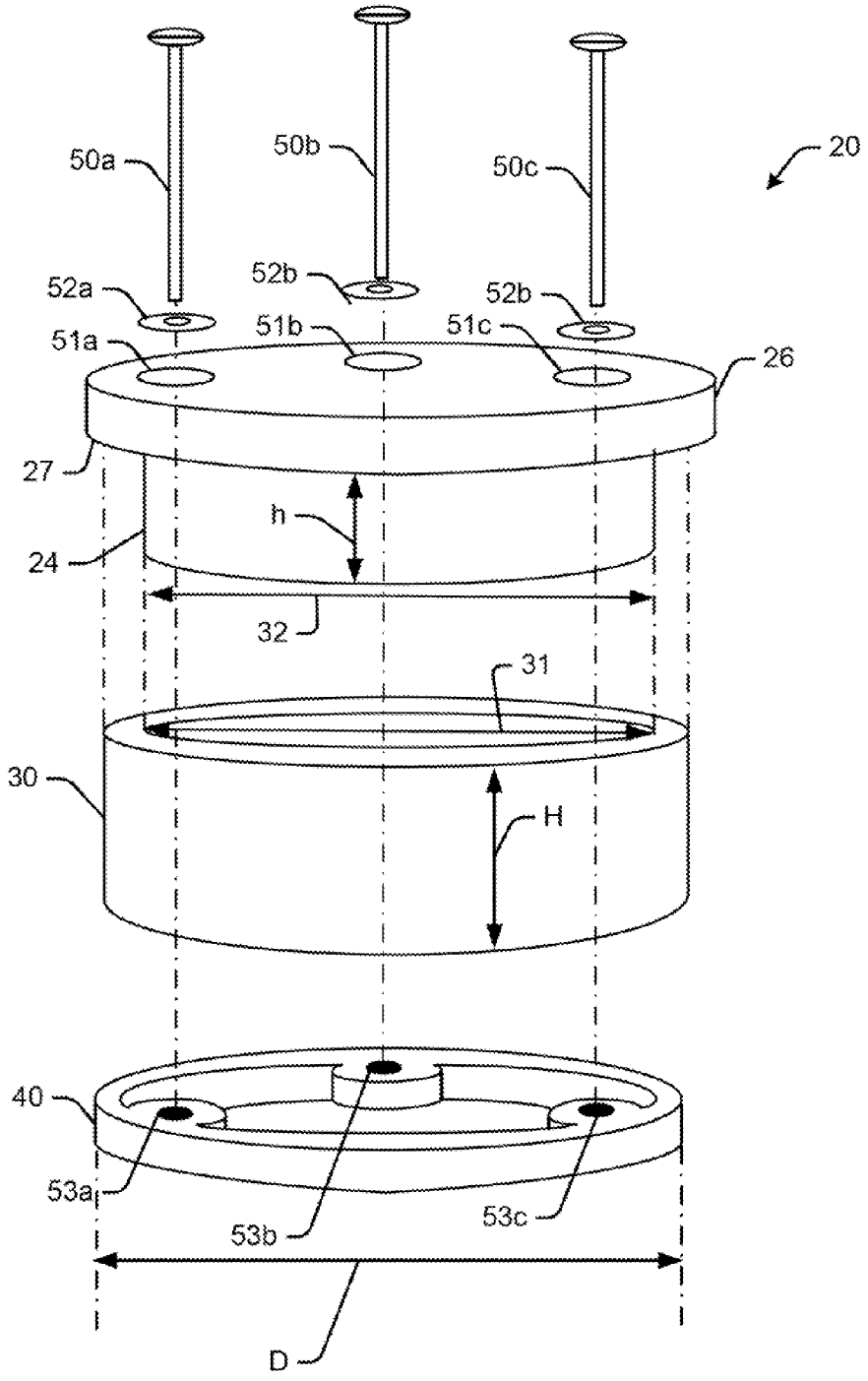
FIG. 3 is an exploded view showing components of the example top drain assembly of FIG. 1.

FIG. 3 is an exploded view showing components of the example top drain assembly 20 of FIG. 1. In an example, the top drain assembly 20 has a smaller diameter lower lip 24 configured to fit within the compressible fitting 30. The top drain assembly 20 also has a larger diameter upper plate 26 with an upper lip 27 configured to abut against an upper edge 11 (about the circumference of the opening) of the drain body 10 (see, e.g., FIG. 1).

The lower lip 24 of the top drain assembly 20 may be configured to receive the compressible fitting 30. In an example, an inner diameter 31 of the compressible 30 fitting is substantially the same as an outer diameter 32 of the lower lip 24 of the top drain assembly 20. In addition, the compressible fitting 30 may have a height H that is larger than a height h of the lower lip 24.

The top drain assembly 20 may also have a bottom plate 40. In an example, an outer diameter D of the bottom plate 40 is substantially the same as an outer diameter of the compressible fitting 30. In example, the outer diameter D of the bottom plate 40 may be smaller than the inner diameter of the drain body 10 (e.g., about one-eighth inch smaller to facilitate easy insertion).

In an example, fastener(s) 50*a-c* may be provided in openings 51*a-c* (with optional washers 52*a-c*) and through an inside of the lower lip 24, to engage with openings 53*a-c*. Fasteners 50*a-c* may have a flattened edge (not shown) at or near the bottom tip, to aid in preventing loosening of the fasteners from the bottom plate 40. Openings 53*a-c* may be threaded so that nuts do not need to be provided. That is, the upper plate 26 has openings to receive the fasteners 50*a-c* which connect with corresponding openings 53*a-c* in the bottom plate 40. As such, tightening the fasteners 50*a-c* installed through the upper plate 26 and the lower plate 40 compresses the compressible fitting 40 (e.g., "sandwiching" the compressible fitting 40 therebetween) and causes the compressible fitting 30 to bulge (at least to some degree) outward to engage an interior 13 of the drain body 10 (see, e.g., FIG. 1).

Figure 4A:
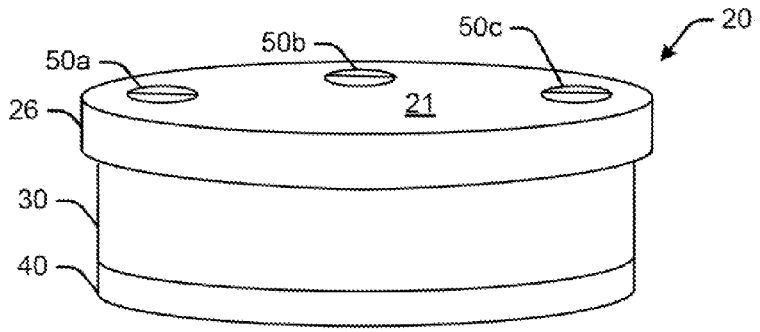
FIG. 4A shows the top drain assembly of FIG. 3 in a first illustrative configuration.

FIG. 4A shows the top drain assembly of FIG. 3 in a first illustrative configuration (e.g., plumb installation). In this example, the top drain assembly 20 may fit into the top of the drain body 10 such that these may fit into each other directly or 'plumb' (e.g., each component is at the same angle relative to each other; there is no (or zero degree) difference in their angles relative to each other).

Figure 4B:
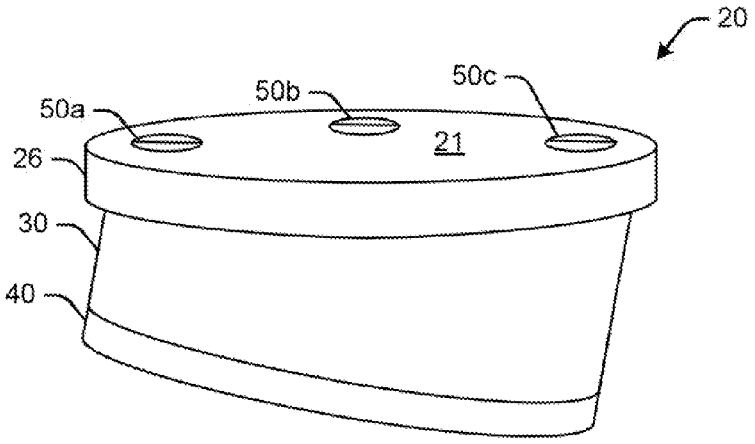
FIG. 4B shows the top drain assembly of FIG. 3 in a second illustrative configuration.

However, the top drain assembly 20 is not limited to only plumb installations. Indeed, oftentimes it is difficult to have a perfectly plumb installation, given the nature of construction. As such, the top drain assembly 20 may also be used in non-plumb installations. FIG. 4B shows the top drain assembly of FIG. 3 in a second illustrative configuration. In this example, the compressible fitting 30 bends to enable non-plumb installations. In other words, the top plate 26 may fit into the drain body 10 at an angle 60 relative to plumb (e.g., sitting at angles different than each other), yet the top surface 21 is still level (e.g., parallel to the ground 61).

Figure 5:
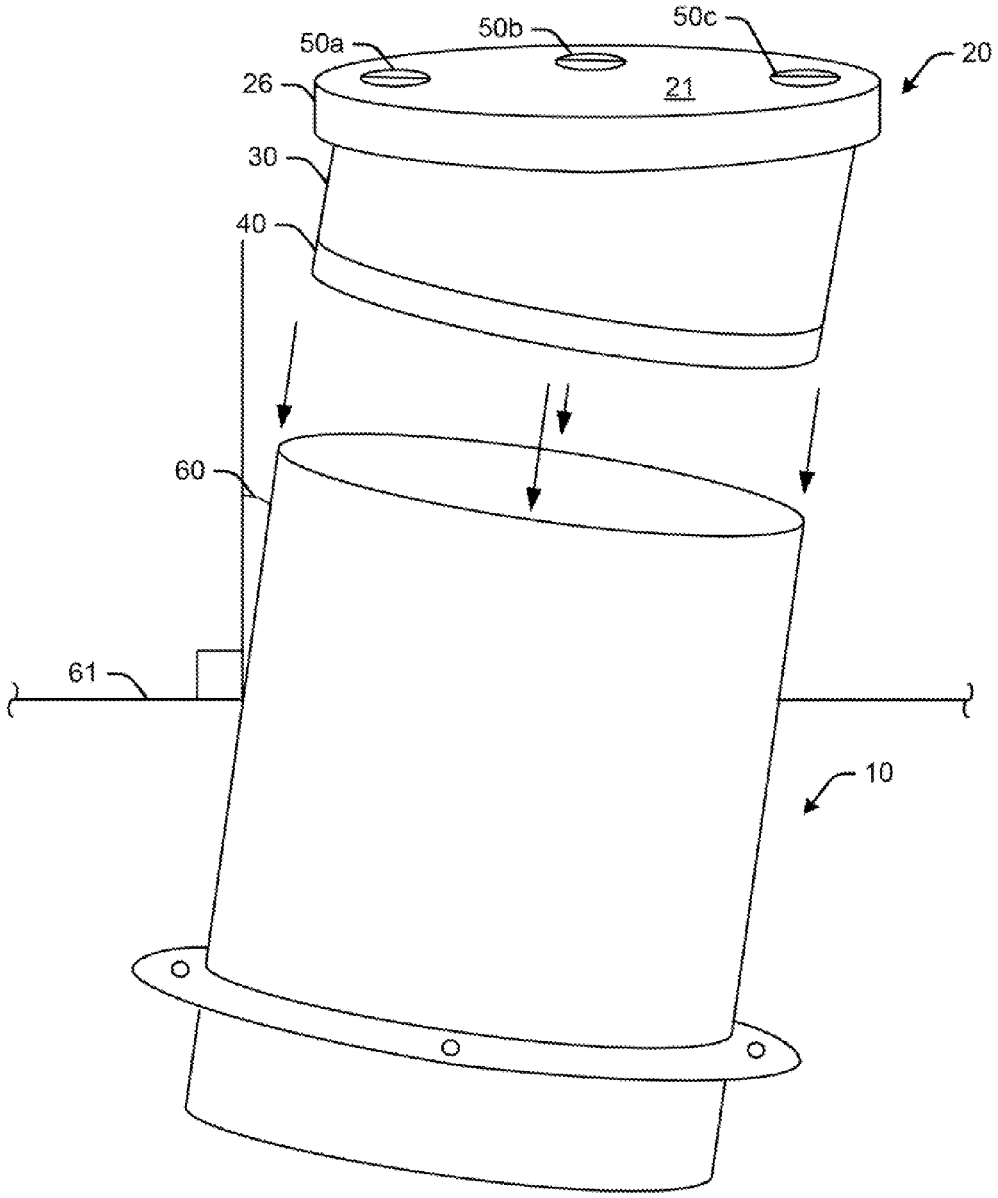
FIG. 5 shows the example drain apparatus and system as it may be installed at an offset.

FIG. 5 shows the example drain apparatus and system as it may be installed at an offset. As shown in FIG. 5, the top surface 21 and body portion (e.g., after installation in the drain body 10) may fit together although their angle relative to a fixed point may be different.

Before continuing, it should be noted that the examples described above are provided for purposes of illustration, and are not intended to be limiting. Other devices and/or device configurations may be utilized to carry out the implementations described herein.

FIGS. 6-13 illustrate installation of the example drain apparatus and system in a concrete base. The drain apparatus may be installed for example in any suitable location, such as but not limited to a restroom, shower, or other room where floor drainage is needed (e.g., an industrial kitchen, public restroom, mechanical room, general use area, a car wash), or any facility where one may need to drain water from an area or provide a drain cleanout.

Figure 6:
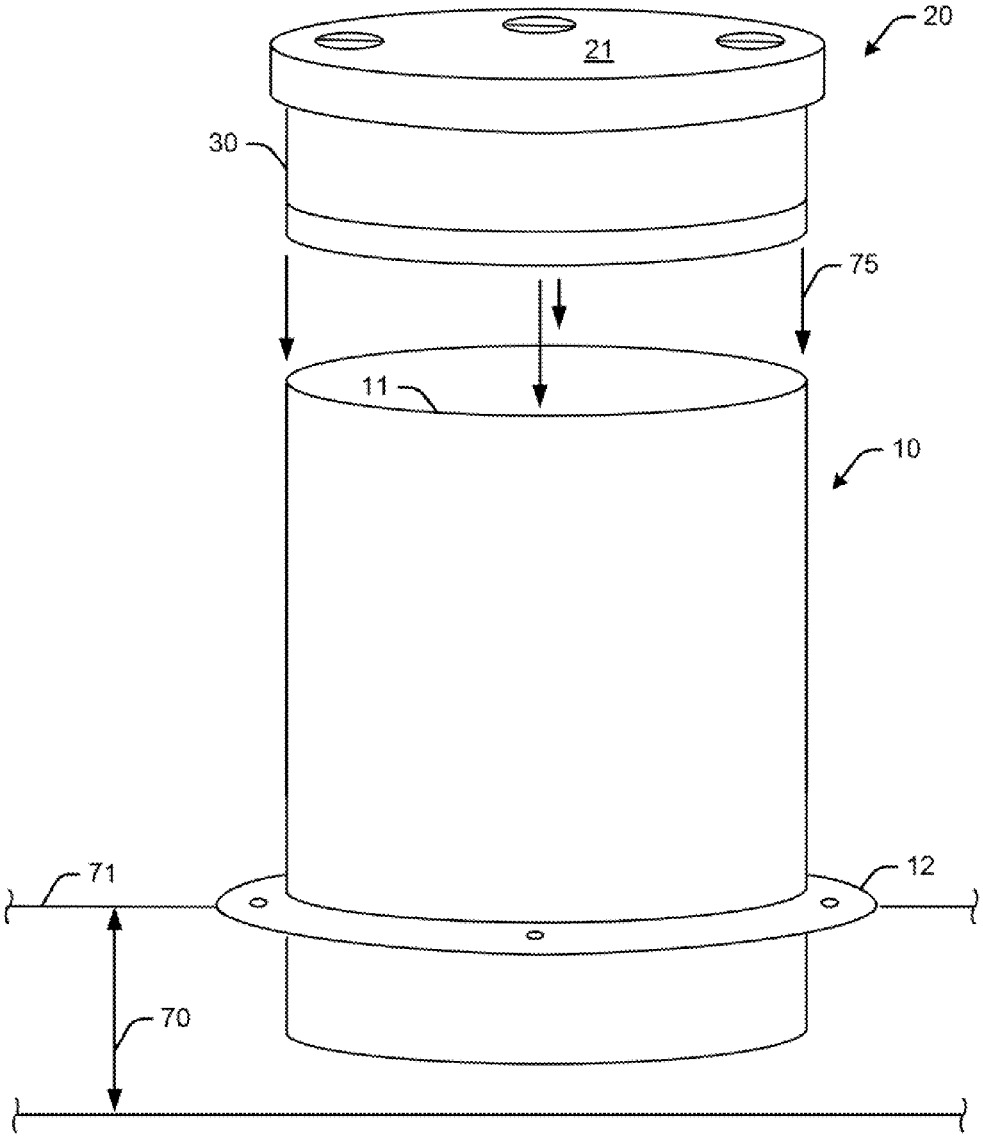
FIGS. 6-13 illustrate installation of the example drain apparatus and system in a concrete base.

FIG. 6 illustrates the drain apparatus installed in a subbase (e.g., a dirt or gravel subfloor). As noted above with reference to FIGS. 4A-4B, the drain body 10 does not have to be perfectly level or plumb. The drain body is configured such that a cut is made after the finished floor is set, determining the finished height of the drain or clean out. The top drain assembly 20 can then be installed in any suitable position and still provide a plumb or substantially level top surface for the drain cover.

Although not shown, the drain apparatus may be connected to a pipe system (e.g., a sewer or waste pipe). The flange 12 may be adjusted on the drain body 10 such that the flange 12 sits at the upper surface 71 of the subbase. In an example, the flange 12 may be affixed to the subbase, e.g., with a threaded fastener or stake (not shown). Once installed, the top drain assembly 20 may be installed by fitting onto the drain body 10 as illustrated by arrows 75 and shown installed in FIG. 7, e.g., as explained above with reference to FIGS. 3 and 4A-B. In an example, a cover without drainage is installed as part of the top drain assembly 20 so as to prevent debris from entering into the drain during construction.

Figure 7:
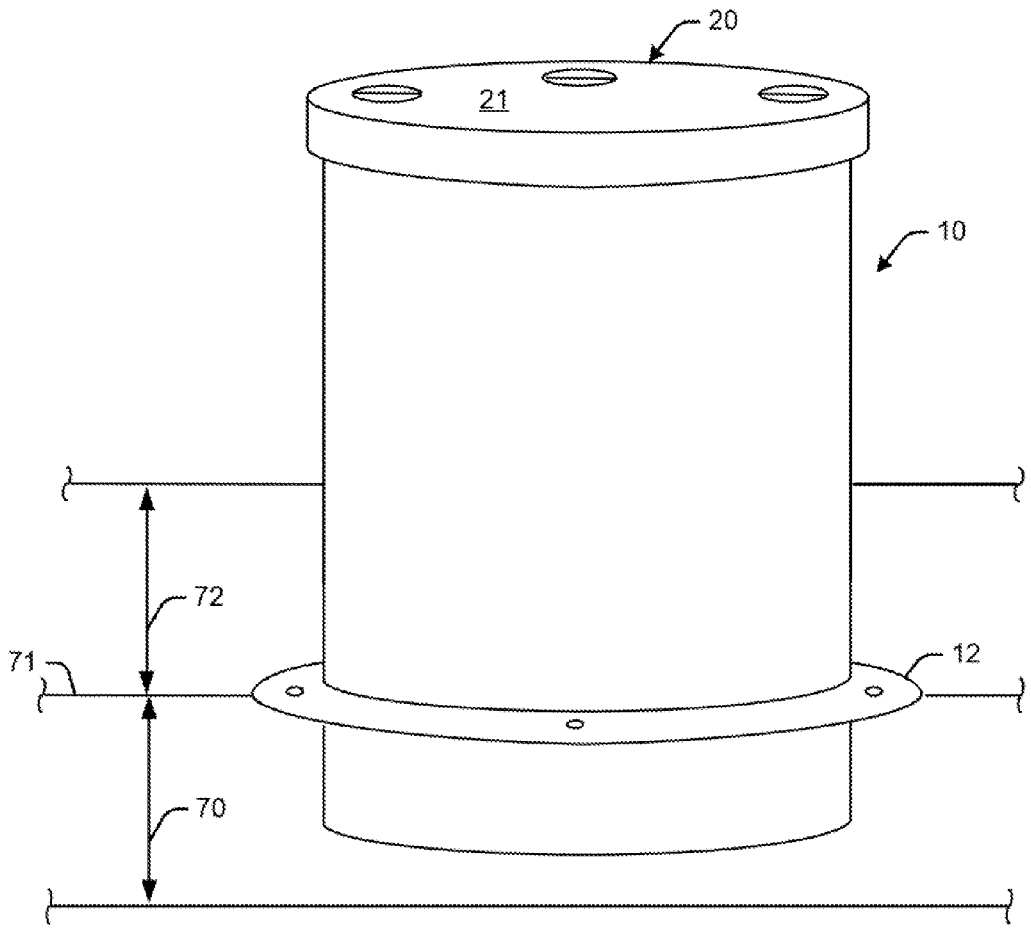
Figure 8:
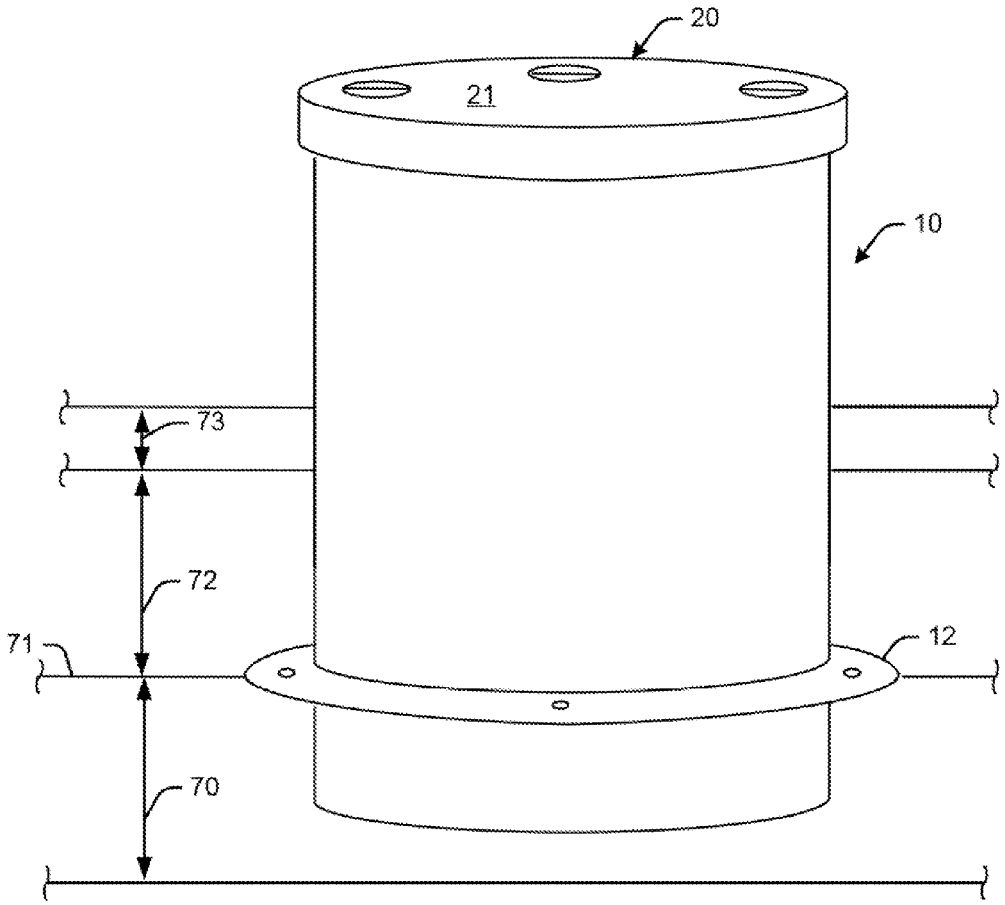

FIG. 7 illustrates the drain apparatus installed in the subbase as in FIG. 6, and further illustrates a concrete layer 72 poured over the subbase 70. FIG. 8 illustrates a flooring layer installed over the concrete layer 72. For example, a tile, hardwood or other flooring material may be installed over the concrete layer 72.

Figure 9:
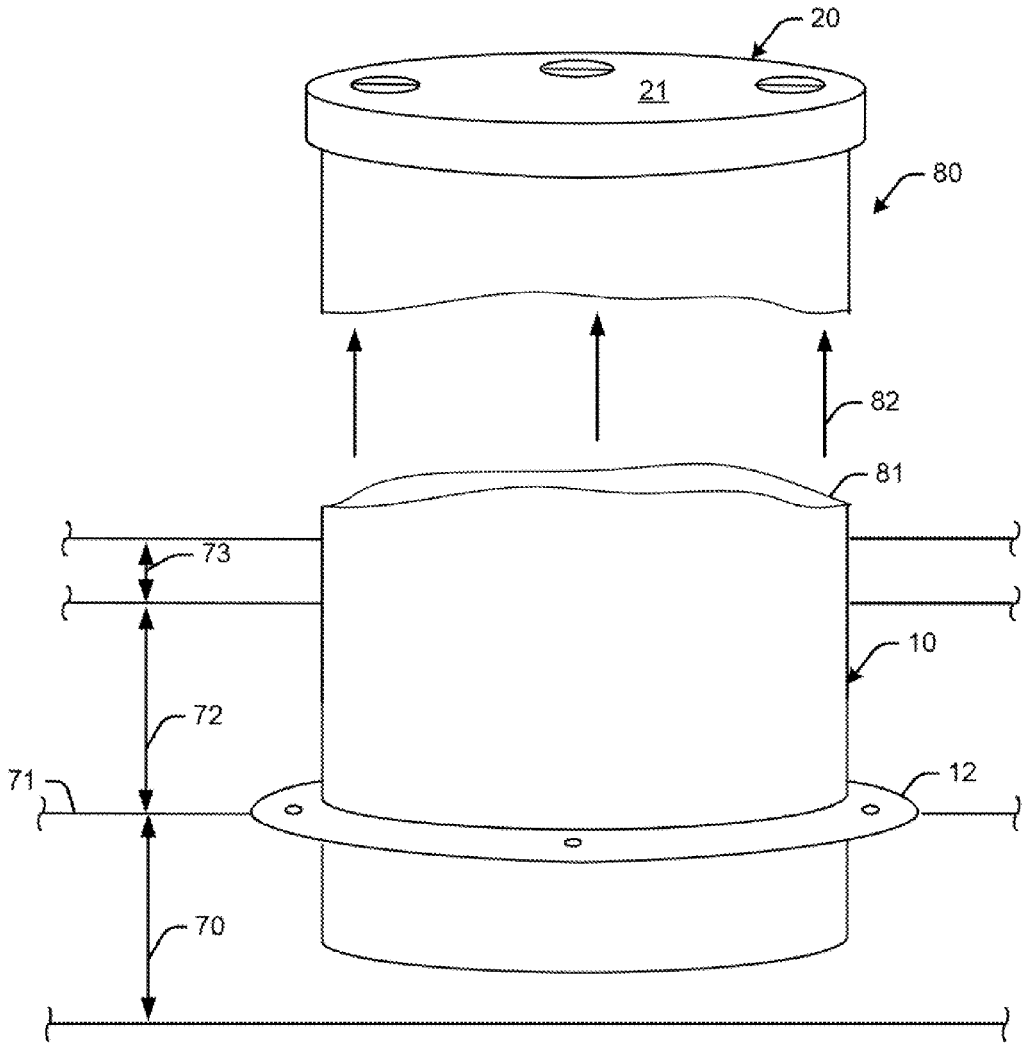
Figure 10:
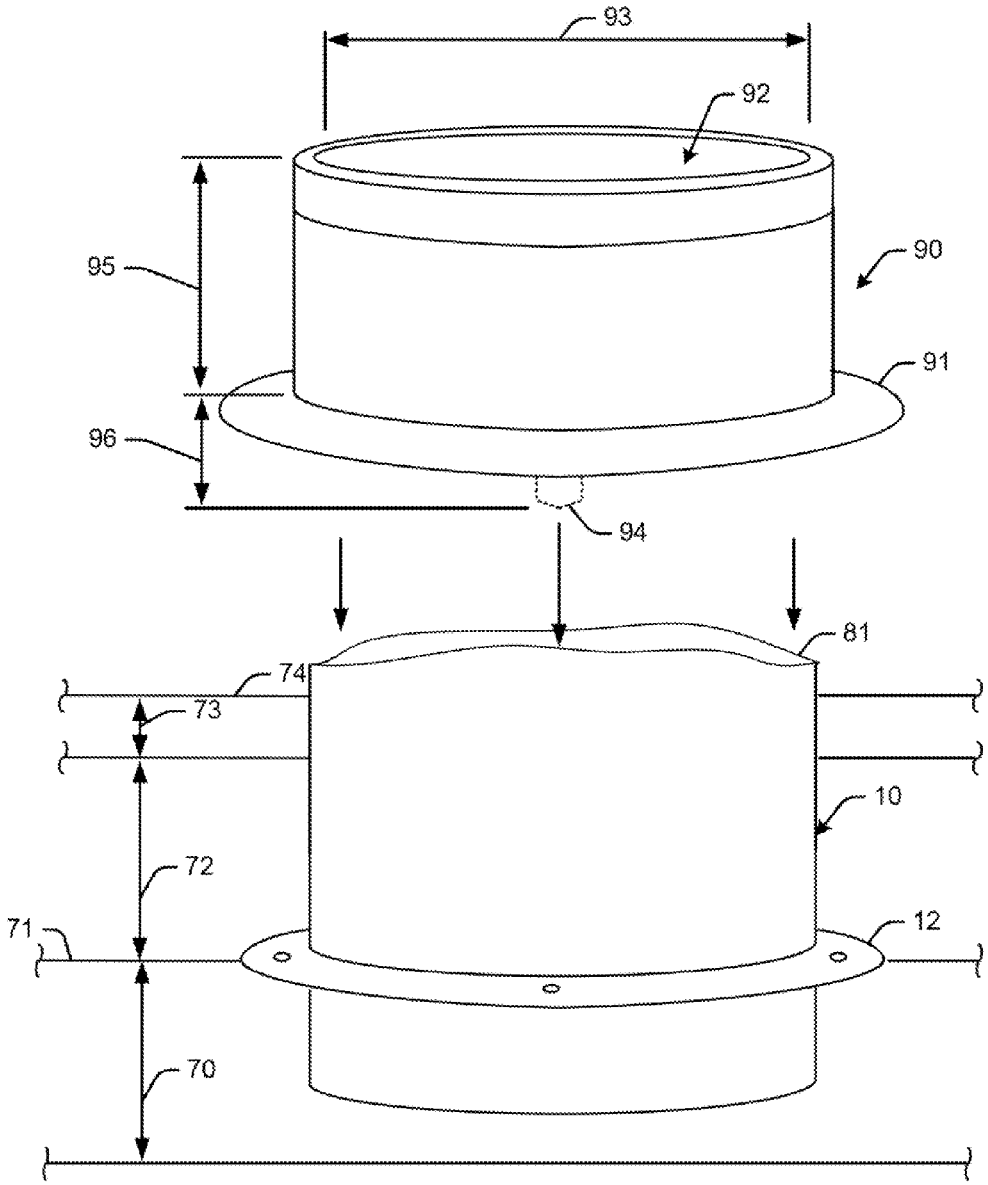
Figure 11:
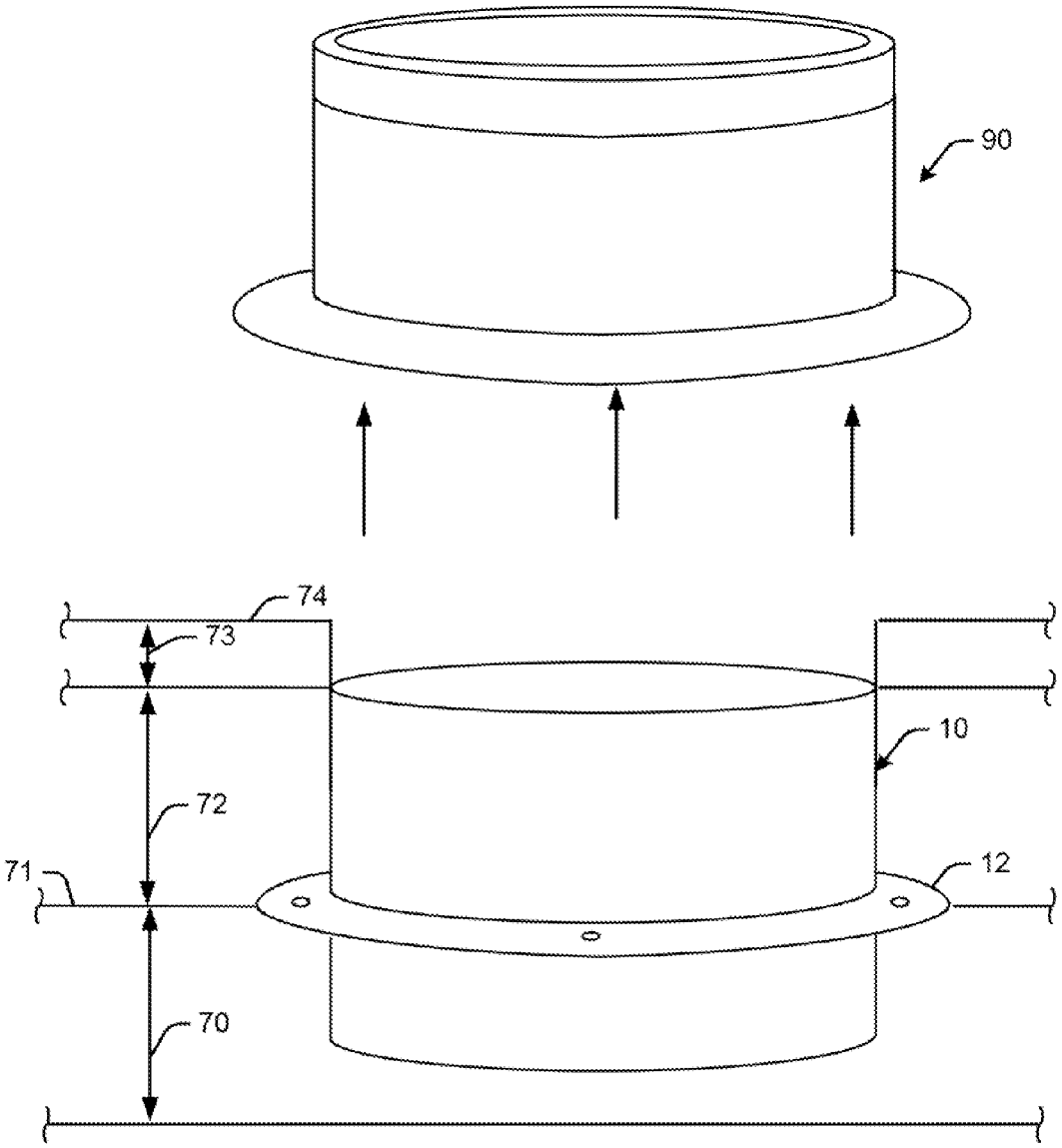

FIG. 9 illustrates the drain apparatus as the top portion 80 may be cut 81 and removed 82 from the drain body 10. As illustrated, the body is cut to a top height of approximately 2" over the floor covering surface. By design, the cut cannot be wrong. The cut can be made to follow the floor depth, for example with a jig. FIG. 10 illustrates a jig 90 which may be fitted over the cut 81 of drain body 10. In an example, the jig 90 has an outer lip 91 configured to abut the top surface 74 of the upper most layer 73. It is noted that in this example, the upper most layer is the tile or other finished flooring product. In other examples, however, the upper most layer may be the concrete 72 or other layer.

In an example, the jig 90 has an opening 92 provided through the top and bottom of the jig 90 for receiving a router or other cutting or grinding tool. The inner diameter 93 of the jig 90 may be at least somewhat larger than the outer diameter of the drain body 10 so that the jig 90 be fitted over the drain body 10 with the outer lip 91 sitting flush with the top surface 74 of the upper most layer 73.

For purposes of illustration, a router bit 94 is shown in outline as it may extend from the router (not shown) through the bottom opening of the jig 90. In an example, the router bit 94 extends a distance 96 below the outer lip 91. That is, the router bit 94 extends from the router for the depth of the jib 95 plus an additional depth 96. As such, when the router bit 94 cuts the drain body 10, the drain body is removed at a depth 96 below the top surface 74 of the upper most layer 73. In an example, the depth 96 is selected to be about the same as the thickness of the upper plate 26 so that the top surface 21 of the upper plate 26 sits substantially flush with the top surface 74 of the floor layer 73, as illustrated by the installation in FIGS. 12 and 13. It is noted, however, that in other examples the drain body 10 may be cut to any suitable height (flush with, below, or above the top surface 74).

Figure 12:
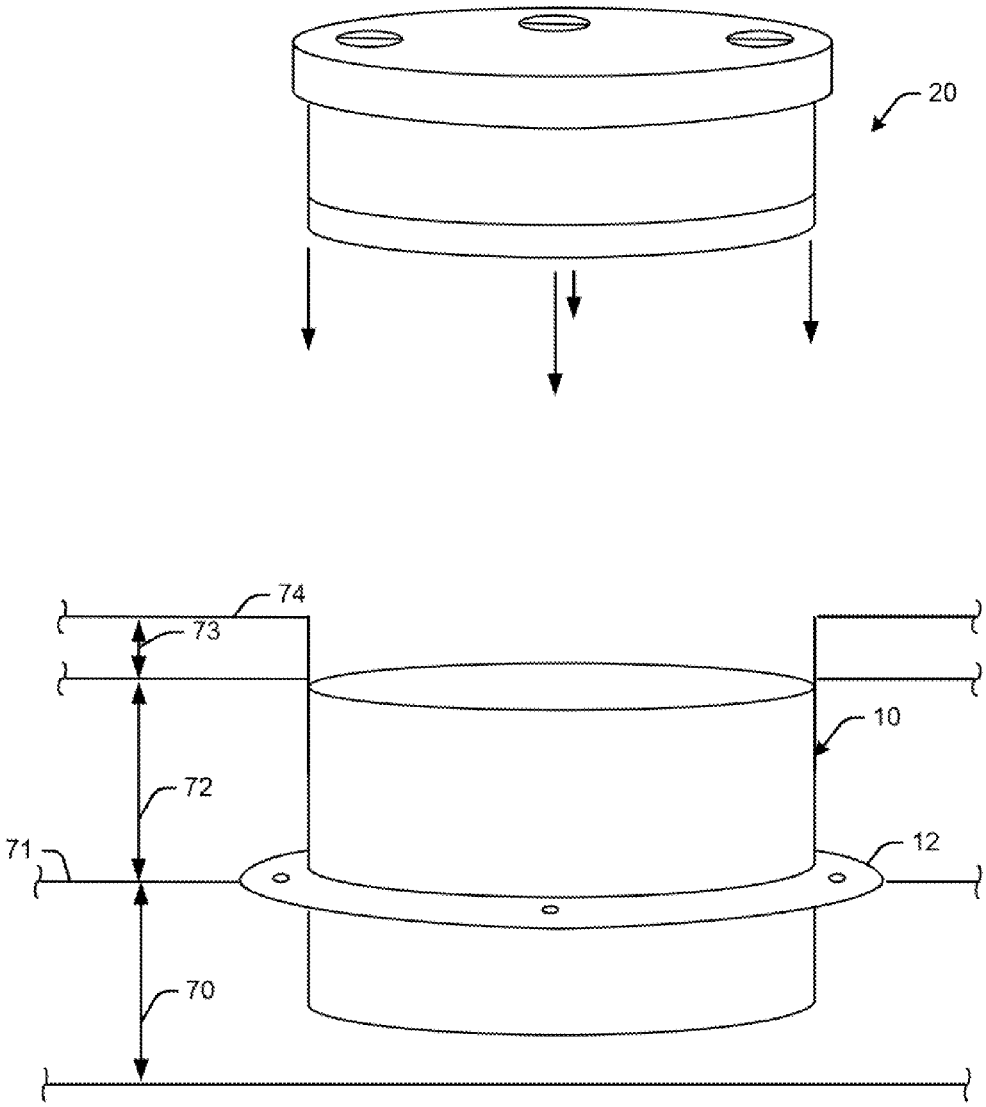

After the drain body 10 is prepared (e.g., cut off and/or after using the jig), the top drain assembly 20 can be installed as illustrated in FIG. 12. In an example, the top drain assembly 20 may include a top cover (e.g., drain or strainer or cap), a compressible fitting 30 (e.g., a polyurethane gasket), a bottom plate 40, and screws 50*a-c* (see, e.g., FIG. 3). Different degrees of offsets are available for the top to eliminate the need for the body to be perfectly plumb (see, e.g., FIGS. 4A-B).

Figure 13:
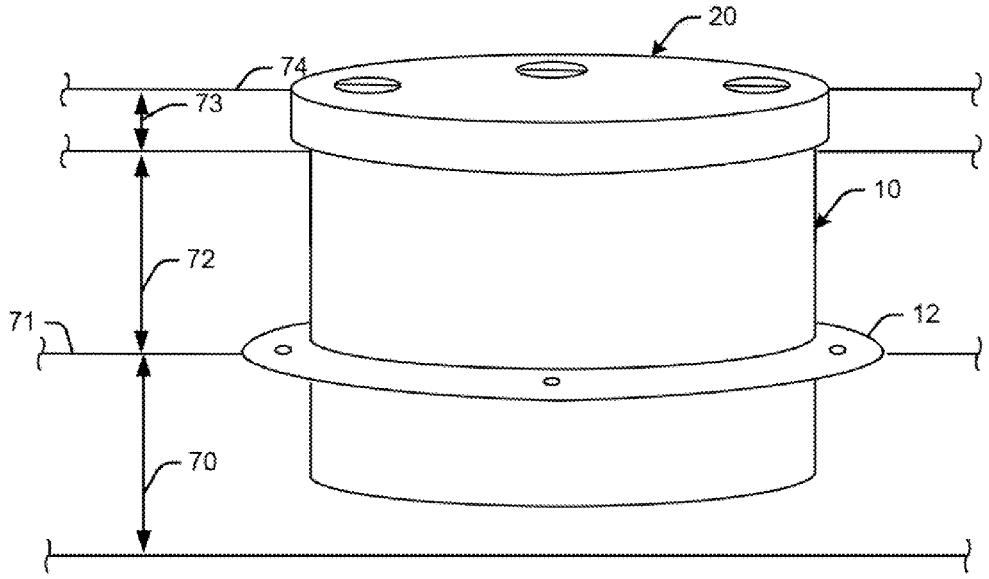

The final product shown in FIG. 13 is a floor drain or floor clean out that is installed meeting the finished floor requirements. The screws 50*a-c* tighten the upper plate 26 to the bottom plate 40 which compresses the compressible fitting 30 to form a water (and air or other gas)-tight seal to the body. Other sealing methods may be implemented (e.g., pipe cement, foam or other gaskets).

The operations shown and described herein are provided to illustrate example implementations. It is noted that the operations are not limited to the ordering shown. Still other operations may also be implemented.

Figure 14:
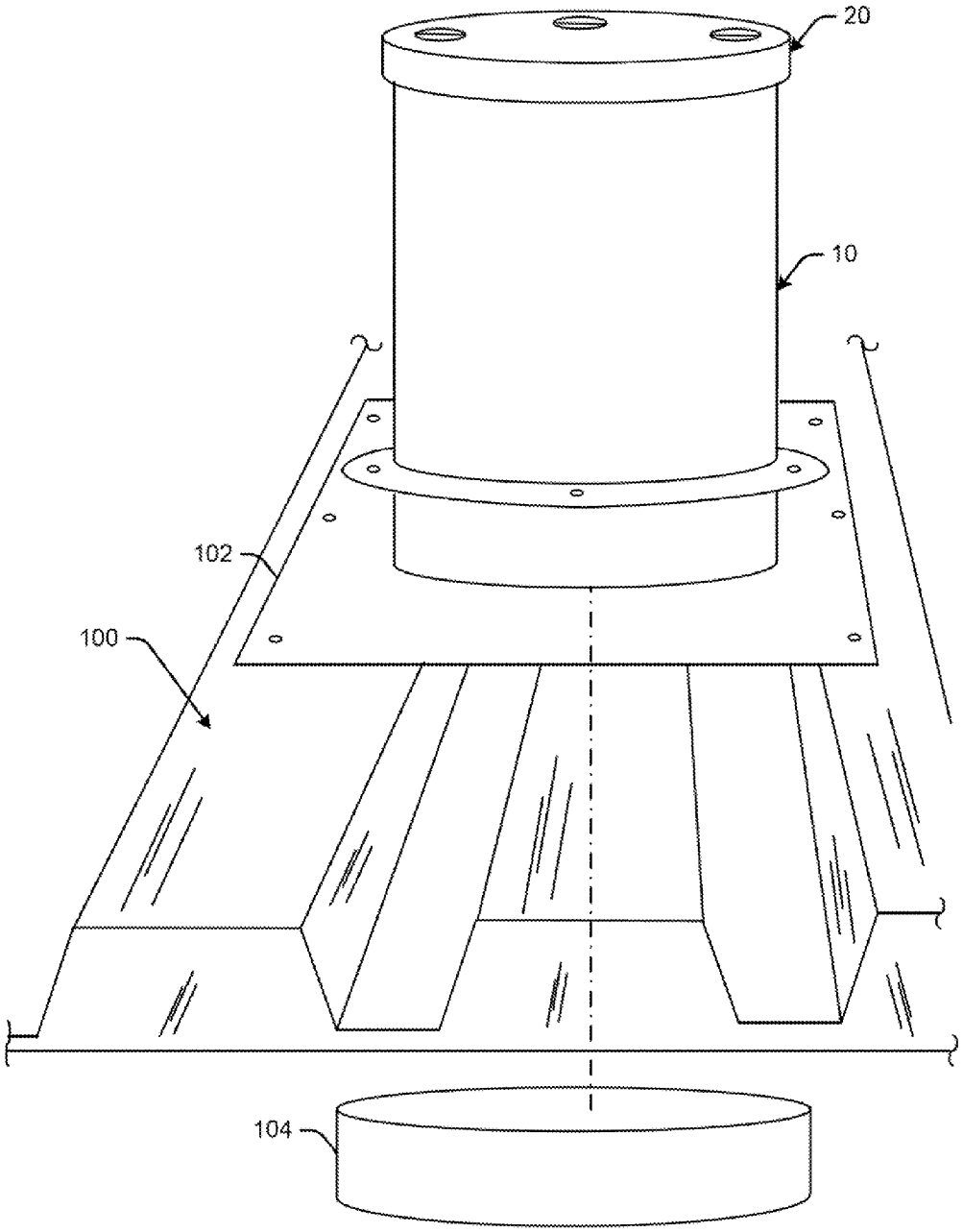
FIG. 14 illustrates installation of the example drain apparatus and system in a metal decking.

FIG. 14 illustrates installation of the example drain apparatus and system in a metal decking 100 or other base. In an example, a spreader support 102 may be provided to span the decking 100. In an example, a deck extender 104 may be provided, e.g., to connect the drain body 10 and extend through the metal decking 100 to the drain system pipe below the metal decking. The spreader support 102 may be mounted with fasteners (openings for attaching fasteners are shown in FIG. 14), otherwise connected to the metal decking (e.g., by adhesive).

Figure 15:
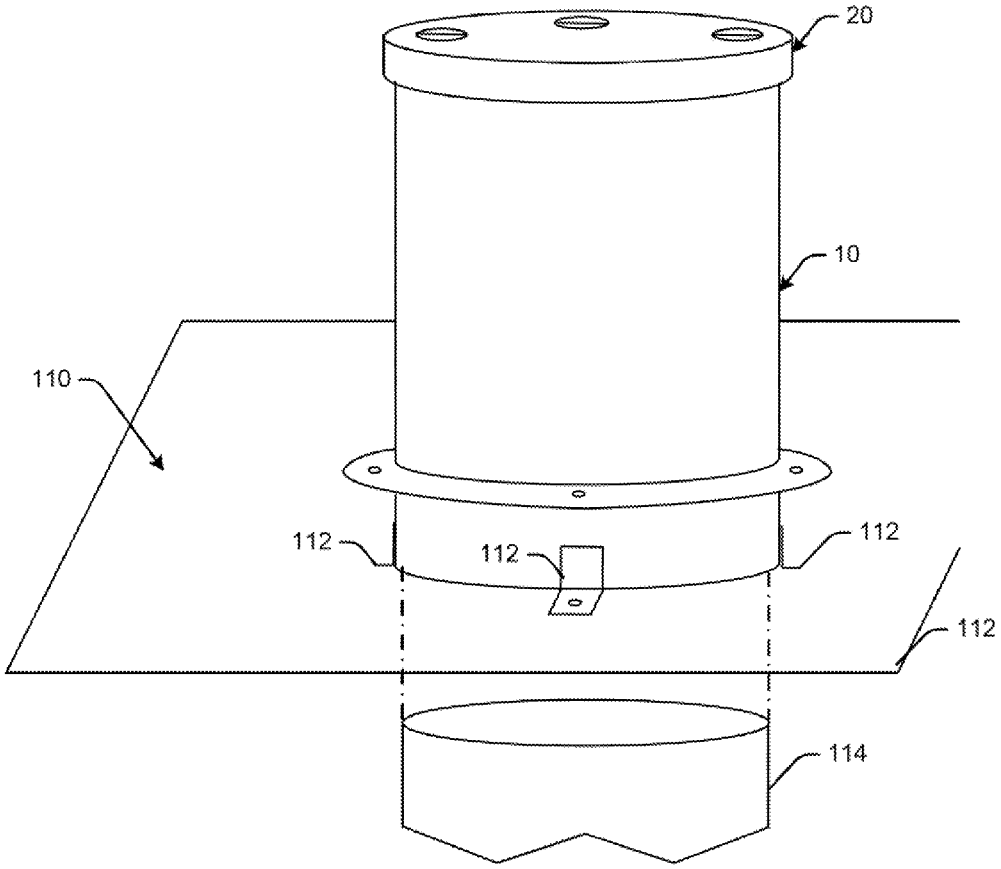
FIG. 15 illustrates installation of the example drain apparatus and system in a wood decking.

FIG. 15 illustrates installation of the example drain apparatus and system in a wood decking 110 or other base. In an example, sleeve clip(s) 112 may be employed to aid in securing the drain body 10 to the wood decking 110. An opening may be formed (e.g., a hole cut) through the wood decking and the drain body 10 connected to the drain system pipe 114 below the wood decking 110.

Figure 16:
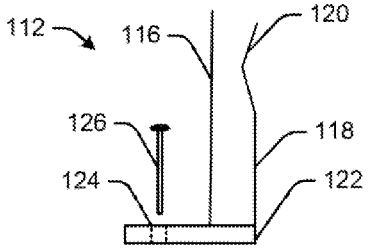
FIG. 16 shows an example clip which may be implemented for installation of the example drain apparatus and system.

FIG. 16 shows an example clip 112 which may be implemented for installation of the example drain apparatus and system. In an example, the clip 112 may include clip portions 116 and 118 to receive the base of the drain body 10 therebetween. In an example, clip portion 118 (or 116) may have an indentation to aid in securing the clip 112 to the drain body 10. The clip 112 may include a base portion 122 with an opening 124 formed therethrough to receive a fastener 126 to fasten the clip 112 to the wood decking 110.

Figure 17:
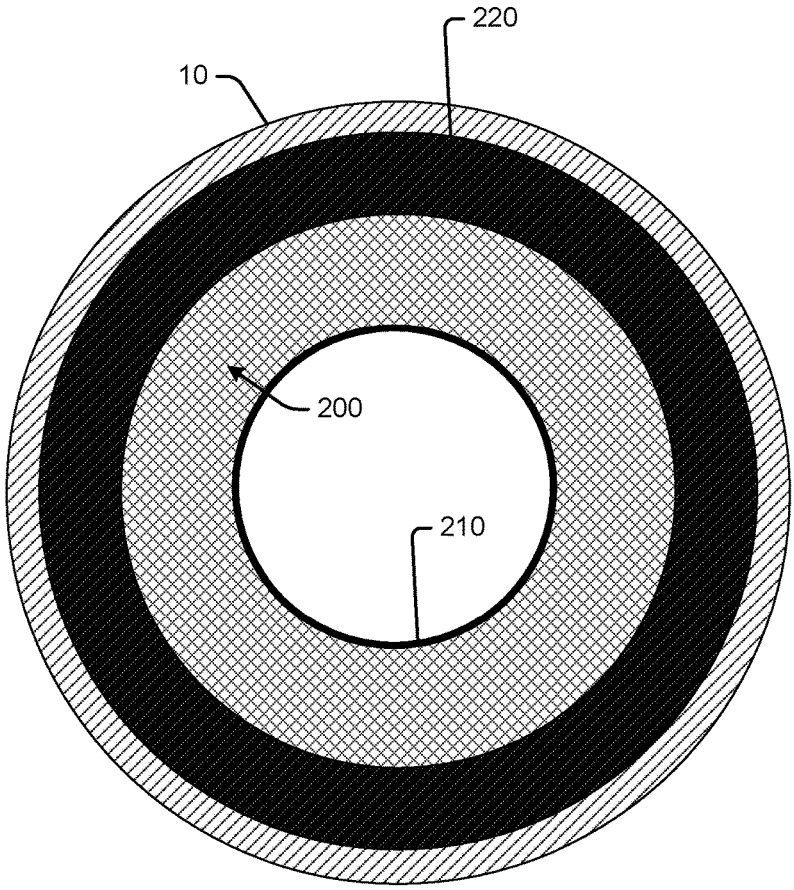
FIG. 17 is an end view of the example drain body.

FIG. 17 is an end view of the example drain body 10 showing a fire stop 220 and a pipe hub 210. An annular space 200 is formed in the drain body 10 between the pipe hub 210 and the fire stop 220.

The examples shown and described are provided for purposes of illustration and are not intended to be limiting. Still other examples are also contemplated.

The invention claimed is:

1. A drain apparatus, comprising:

a drain body having a cylindrical shape, the drain body configured to position through an opening formed in a floor, the drain body having an upper portion configured for installation above the floor, the upper portion configured for connection to a drain apparatus pipe of a plumbing system above the floor, and the drain body having a lower portion configured for installation below the floor; and a pipe hub formed within the lower portion of the drain body, the pipe hub configured for connection to a pipe of the plumbing system below the floor;

an outer sleeve of the lower portion of the drain body;

an annular space formed within the drain body between the pipe hub and the outer sleeve of the drain body;

a pipe coupling band connecting a lower drain system pipe to the pipe hub in the annular space; and a top drain assembly having a compressible fitting, the top drain assembly configured for removable installation within the upper portion of the drain body, wherein the compressible fitting expands outward when tightened to engage an inner perimeter of the upper portion of the drain body.

2. The drain apparatus of claim 1, wherein the drain body is configured for pre-installing in a base before finishing a floor, and then cut below an upper surface of the finished floor so that the top drain assembly is fitted to the drain body and covered level with the upper surface of the finished floor.

3. The drain apparatus of claim 1, wherein the drain body further comprises a flange.

4. The drain apparatus of claim 1, wherein the drain body walls are made of multiple layers, one of which is a rubber layer.

5. The drain apparatus of claim 1, wherein the drain body walls are made of multiple layers, one of which is a fire stop layer.

6. The drain apparatus of claim 1, wherein the top drain assembly has a lower lip configured to fit within the compressible fitting, and an upper plate configured to abut against the drain body, wherein the lower lip has a smaller diameter than the upper plate.

7. The drain apparatus of claim 6, wherein the smaller diameter lower lip of the top drain assembly is configured to receive the compressible fitting thereon.

8. The drain apparatus of claim 7, wherein an inner diameter of the compressible fitting is the same as an outer diameter of the lower lip of the top drain assembly.

9. The drain apparatus of claim 7, wherein the compressible fitting has a height that is larger than a height of the lower lip.

10. The drain apparatus of claim 7, wherein the top drain assembly has a bottom plate.

11. The drain apparatus of claim 10, wherein an outer diameter of the bottom plate is the same as an outer diameter of the compressible fitting.

12. The drain apparatus of claim 10, wherein the upper plate has openings to receive a fastener therethrough, and the bottom plate has corresponding openings to receive the fastener therethrough, wherein tightening the fastener installed through the openings in the upper plate and the openings in the lower plate compresses the compressible fitting and causes the compressible fitting to bulge outward to engage an interior of drain body.

13. The drain apparatus of claim 1, further comprising a replaceable drain cover with drainage.

14. The drain apparatus of claim 1, further comprising a replaceable drain cover without drainage.

15. A drain system, comprising:

an apparatus having a drain body and configured to position through an opening formed in a floor, the drain body having an upper portion configured for installation above the floor, the upper portion configured for connection to a drain apparatus of a plumbing system above the floor, and the drain body having a lower portion configured for installation below the floor;

a pipe hub formed within the lower portion of the drain body, the pipe hub configured for connection to a pipe of the plumbing system below the floor;

an outer sleeve of the lower portion of the drain body;

an annular space formed within the drain body between the pipe hub and the outer sleeve of the drain body, the annular space open to receive a pipe coupling band in the annular space for connecting the pipe of the plumbing system below the floor to an outside perimeter of the pipe hub of the drain body;

a top drain assembly for installation with the upper portion of the drain body, the drain body configured to connect to a pipe of a plumbing system, the drain body having an adjustable flange, wherein an o-ring is positioned between the adjustable flange and the drain body; and a jig configured to cut the drain body below an upper surface of a floor the drain body is installed in so that the top drain assembly is fitted to the drain body.

16. The drain system of claim 15, wherein the top drain assembly has a top plate with a lower lip configured to fit within the drain body, and the top plate having an upper plate configured to abut against the drain body, wherein the lower lip is configured to receive a compressible fitting.

17. The drain system of claim 16, wherein the top drain assembly has a bottom plate.

18. The drain system of claim 17, wherein an outer diameter of the bottom plate is the same as an outer diameter of the compressible fitting.

19. The drain apparatus of claim 18, wherein the upper plate has openings to receive a fastener therethrough, and the bottom plate has corresponding openings to receive the fastener therethrough, wherein tightening the fastener installed through the openings in the upper plate and the openings in the lower plate compresses the compressible fitting and causes the compressible fitting to bulge outward to engage an interior of drain body.

20. A method comprising:

providing a drain body in a floor, the drain body having an interior annular space configured to position through an opening formed in a floor, the drain body having an upper portion configured for installation above the floor, the upper portion configured for connection to a drain apparatus pipe of a plumbing system above the floor, and the drain body having a lower portion configured for installation below the floor; and providing a pipe hub formed within the lower portion of the drain body, the pipe hub configured for connection to a pipe of the plumbing system from below the floor;

providing an outer sleeve of the lower portion of the drain body;

providing an annular space formed within the drain body between the pipe hub and the outer sleeve of the drain body;

receiving a pipe coupling band in the annular space for connecting the pipe from below the floor to an outside perimeter of the pipe hub of the drain body;

providing a top drain assembly for installation with the upper portion of the drain body;

providing a jig to cut the drain body below an upper surface of a floor the drain body is installed in so that the top drain assembly is fitted to the drain body level with the upper surface of the floor.

* * * * *